United States Patent [19]

Townsend et al.

[11] Patent Number: 4,796,706

[45] Date of Patent: Jan. 10, 1989

[54] LINER SETTING APPARATUS AND METHOD FOR USE IN WELL CASINGS

[76] Inventors: Thomas R. Townsend, 1666 Myrtle Ave., Bakersfield, Calif. 93301; Mitchell Townsend, 7201 Angela Ave., Bakersfield, Calif. 93308

[21] Appl. No.: 176,962

[22] Filed: Apr. 4, 1988

[51] Int. Cl.[4] ..... E21B 43/10

[52] U.S. Cl. ..... 166/380; 166/55; 166/181; 166/387

[58] Field of Search ..... 166/181, 55, 387, 195, 166/202, 203, 381, 387, 206, 207, 217, 380

[56] References Cited

U.S. PATENT DOCUMENTS

| | | | |
|---|---|---|---|
| 2,806,537 | 9/1957 | Sparks, Sr. | 166/202 X |
| 3,108,638 | 10/1963 | Burns | 166/124 |
| 3,131,768 | 5/1964 | Chancellor et al. | 166/181 |
| 3,152,643 | 10/1964 | Burns | 166/124 |
| 3,568,773 | 3/1971 | Chancellor et al. | 166/181 X |

*Primary Examiner*—Stephen J. Novosad
*Attorney, Agent, or Firm*—John J. Posta, Jr.

[57] ABSTRACT

A device for use in setting a liner in a well casing is disclosed which utilizes a setting sleeve connected to the top of the liner, which setting sleeve has an annular sealing flange located on the outer surface thereof. A tubular flaring sleeve fits over the outer diameter of the top of the setting sleeve, and a beveled end on the bottom of the flaring sleeve is used to flare the annular sealing flange radially outwardly in a uniform manner since the beveled end will always remain aligned with the annular sealing flange. In addition, when the setting device and liner are being lowered into the well casing, the flaring sleeve is locked in an upward position on the setting sleeve preventing premature flaring of the annular sealing flange prior to installation of the liner at the bottom of the well.

18 Claims, 2 Drawing Sheets

LINER SETTING APPARATUS AND METHOD FOR USE IN WELL CASINGS

BACKGROUND OF THE INVENTION

1. Field of the Invention

The present invention relates generally to an apparatus and a method for sealably setting a tubular liner inside a cylindrical well casing, and more particularly to an improved two piece liner setting apparatus and method for installing a liner with an improved degree of precision in the seal between the liner setting apparatus and the well casing.

When removing oil from oil wells and the like, it is desirable to inhibit the amount of particulates such as sand which are allowed into the line. This is generally accomplished by using a finely perforated tubular disposed within the well casing of the well closely adjacent to the bottom thereof. The perforated tubular liner thus acts as a strainer to inhibit the passage of sand and like particulates into the line through which the production fluid is drawn from the well.

Such perforated tubular liners generally have an outer diameter which is substantially smaller than the inner diameter of the well casing, thus creating an annular passage between the well casing and the liner. This annular passage allows the production fluid to be drawn radially into the perforated tubular liner, and then upwardly from the well through an elongated string of production tubing lowered into the well casing into fluid communication with the liner. The lower end of the production tubing is generally inserted into the top of the liner, and will operate to draw essentially particulate-free production fluid from the well by suction.

In order to ensure that all production fluid removed from the well passes through the perforated tubular liner, it is necessary to provide a secure seal between the top of the liner and the interior of the well casing. This seal will prevent the passage of particulate matter upward between the well casing and the liner, and then downward into the open end of the liner and into the production fluid drawn from the well. Typically, a seal ring with a diameter approximately equal to the inner diameter of the well casing is disposed at the top of the liner, with the liner being installed by forcing the seal ring into the well casing and sliding the liner down to the bottom of the well casing.

During the installation of the liner, the seal ring is frequently damaged, particularly when the inner wall of the casing is roughened by cement deposits or scale, or when the segments of the casing are misaligned, kinked, out of round, or otherwise damaged. In addition to rendering the seal ineffective, this damage frequently makes installation of the production tubing difficult or impossible. These disadvantages and problems in the art were largely solved by the introduction of the liner setting apparatus described in U. S. Pat. No. 3,568,773, to Chancellor et al., which patent is commonly owned together with the present invention, and which patent is hereby incorporated herein by reference.

The Chancellor et al. device uses a flaring plate to expand a sealing flange on the top of a setting sleeve attached to the top of the liner. Following installation of the liner at the bottom of the well casing, the tubing string is reciprocated to impact on the top of the flaring plate, thereby expanding the sealing flange into a tight sealing relationship with the interior of the well casing. This system works remarkably well, and has only two disadvantages. First, when installing the liner, the flaring plate has a tendency to expand the sealing flange prematurely, particularly when the setting sleeve becomes momentarily stuck in the casing while the liner is being lowered into the well. This problem seriously inhibits the ability to install the liner, particularly in well casings which are more damaged than is typical.

The second problem is a movement off center by the setting sleeve caused by the flaring plate not seating properly. This may result in a non-uniform seal, a substandard seal, or even the lack of a seal in isolated instances. Despite these problems, the Chancellor et al. device represented a great improvement in the ability to properly install liners. It will be appreciated, however, that it is desirable to overcome the problems associated with this device.

Accordingly, it is an objective of the present invention to provide for an improved liner setting apparatus and method which will be easier to install, and which will not expand the seal prematurely. As such, it is desirable to completely and positively inhibit the expansion of the seal until the liner is in place at the bottom of the casing, and this is also an objective of the present invention. It is also an objective of the present invention to ensure proper alignment of the liner setting apparatus, to prevent the apparatus from moving off center. The present invention also has as an objective the consistent formation of a uniform seal. Finally, these objectives and advantages must all be achieved without incurring any relative disadvantage.

SUMMARY OF THE INVENTION

The disadvantages and limitations of the background art discussed above are overcome by the present invention. With this invention, an improved liner setting apparatus is used to install the liner at the bottom of the casing. Like the apparatus of the Chancellor et al. reference mentioned above, the device of the present invention uses an elongated tubular setting sleeve, the lower end of which setting sleeve supports the tubular liner to be placed in the bottom of the well casing. Rather than a flaring plate, the device of the present invention uses a tubular flaring sleeve located at the top end of the setting sleeve.

Located circumferentially around the outside diameter of the setting sleeve at an intermediate location is an annular sealing flange. The annular sealing flange is spaced away from the outer diameter of the setting sleeve, and is supported at the bottom thereof from the setting sleeve. Accordingly, the space between the annular sealing flange and the setting sleeve is open at the top thereof. The tubular flaring sleeve has a beveled lower end which will act to flare out the annular sealing flange when the flaring sleeve is lowered beyond a first position on the setting sleeve.

Movement of the flaring sleeve on the setting sleeve is limited between the first position mentioned above and a second position by pins extending inwardly from the flaring sleeve through longitudinal slots in the setting sleeve. The first position is thus the fully upward position of the flaring sleeve on the setting sleeve, and in this position the beveled end of the flaring sleeve is just above the annular sealing flange. The second position is reached when the flaring sleeve is driven downward on the setting sleeve to flare the annular sealing flange fully outward.

When the device is being lowered into a well, the flaring sleeve is limited to the first position by a setting nut threaded into threads on the interior of the flaring sleeve, with the bottom of the setting nut being in contact with the top of the setting sleeve. It will be appreciated that the liner setting apparatus and method of the present invention thereby effectively prevents the flaring sleeve from expanding the annular sealing flange prematurely when the liner is being installed, even should the setting sleeve become momentarily stuck in the casing while the liner is being lowered into the well.

Following installation of the liner at the bottom of the well casing, the setting nut is backed off to allow the flaring sleeve to be driven to the second position on the setting sleeve. The flaring sleeve is driven to this position by repeated impacts, much as the Chancellor et al. device is sealed within the well casing. The setting nut may then be removed, and the production tubing lowered into place. The liner may therefore be easily and conveniently installed, even in well casings which are more damaged than is typical.

In addition, the design of the present invention using the flaring sleeve and the annular sealing flange also prevents the setting sleeve from moving off center in the well casing, which was previously caused by the flaring plate not seating properly, by maintaining alignment of the flaring apparatus with respect to the setting sleeve. Accordingly, non-uniform seals, substandard seals, or even the lack of a seal are all prevented by the present invention. It may therefore be appreciated that the device and method of the present invention represents a substantial improvement in the ability to easily and properly install liners.

Accordingly, the present invention provides for an improved liner setting apparatus and method which will be easier to install, and which will not expand the seal prematurely. As such, it completely and positively inhibits the expansion of the seal until the liner is in place at the bottom of the casing. The present invention also ensures proper alignment of the liner setting apparatus, thereby preventing the apparatus from moving off center, while forming a uniform seal. Finally, all of the aforesaid objectives and advantages are achieved without incurring any relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
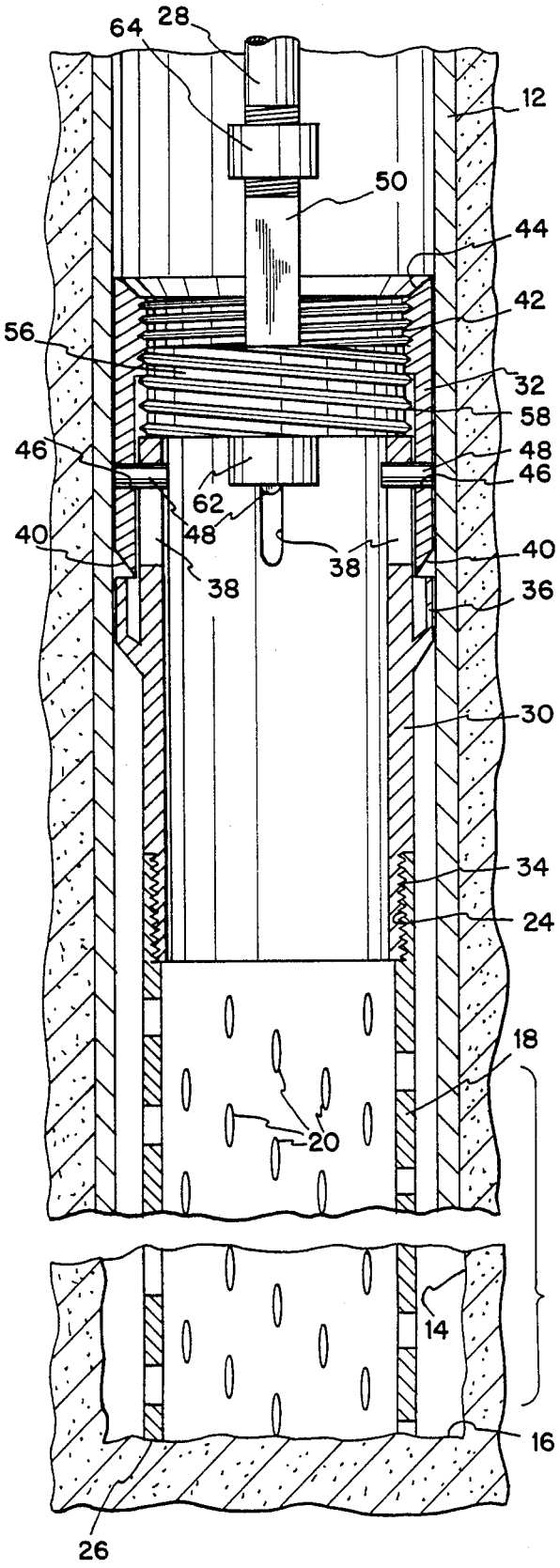
FIG. 1 is a central vertical section through a well bore and casing illustrating the liner setting apparatus of the present invention suspended from a tubing string within the well casing.

The preferred embodiment is illustrated in FIG. 1 disposed within a tubular well casing 12 in a well bore 14, with the well bore 14 having a bottom 16. An elongated tubular liner 18 having a plurality of small slits or perforations 20 therein is adapted to be lowered into the tubular well casing 12 to the bottom 16 of the well bore 14. An elongated annular passage 22 is formed between the elongated tubular liner 18 and the tubular well casing 12. Production fluid enters the interior of the elongated tubular liner 18 from the elongated annular passage 22 through the small slits or perforations 20.

The elongated tubular liner 18 has an upper internally screw-threaded end 24 adapted to be connected to the setting apparatus of the present invention. The lower end 26 of the elongated tubular liner 18 is adapted to be rested on the bottom 16 of the well bore 14. The elongated tubular liner 18 and the setting apparatus are lowered into the tubular well casing 12 by an elongated tubing string 28.

Figure 2:
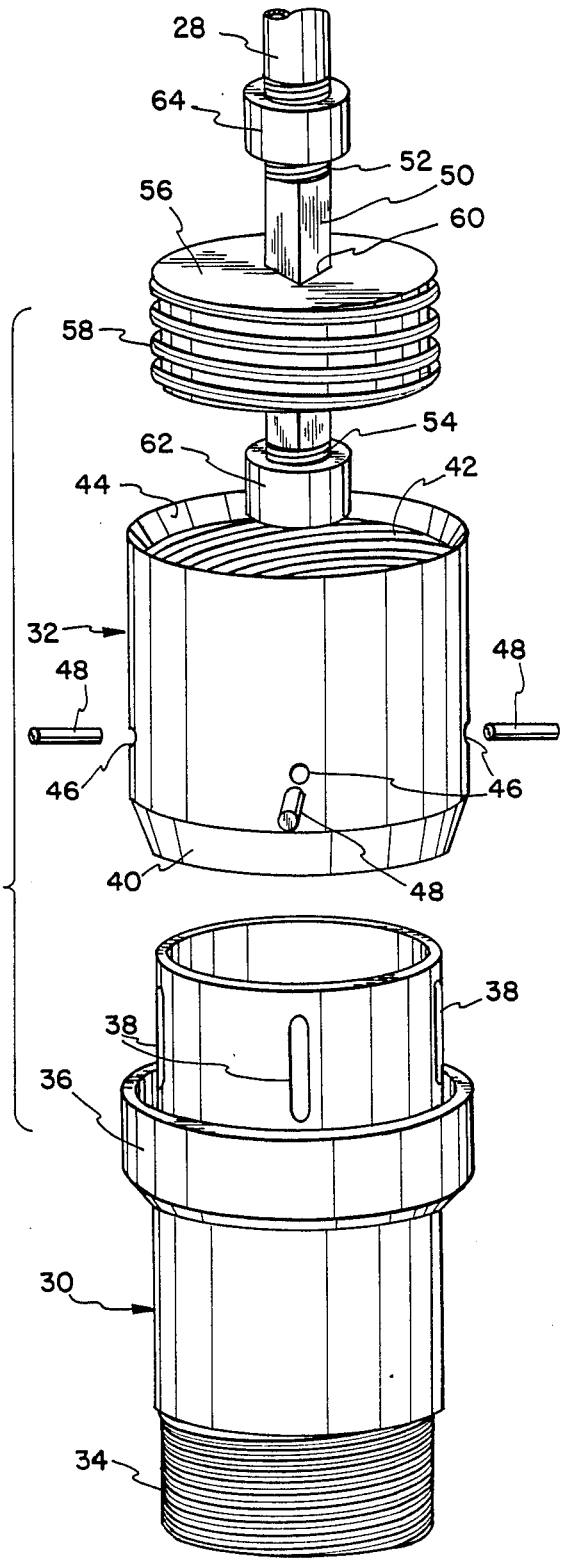
FIG. 2 is an exploded perspective view of the liner setting apparatus of the present invention illustrating the construction of the various components thereof.

Referring now to FIGS. 1 and 2, the apparatus of the present invention consists of two primary components: an elongated tubular setting sleeve 30, and a tubular flaring sleeve 32. The tubular setting sleeve 30 is essentially cylindrical, and has an externally screw-threaded portion 34 at the lower end thereof, which may be of a somewhat reduced diameter. The externally screw-threaded portion 34 of the tubular setting sleeve 30 is designed to mate with the upper internally screwthreaded end 24 of the elongated tubular liner 18.

Located around the outer diameter of the tubular setting sleeve 30 at an intermediate portion thereof is an annular sealing flange 36. The inner diameter of the annular sealing flange 36 is spaced away from the outer diameter of the tubular setting sleeve 30 except at the bottom thereof, where the annular sealing flange 36 is attached to the tubular setting sleeve 30. The outer diameter of the annular sealing flange 36 is designed to fit fairly closely within the tubular well casing 12, and accordingly the bottom of the annular sealing flange 36 where it is attached to the tubular setting sleeve 30 may be angled as shown in FIG. 1 to facilitate introduction of the tubular setting sleeve 30 into the tubular well casing 12.

Completing the construction of the tubular setting sleeve 30 are a plurality of longitudinal slots 38 located near the upper end of the tubular setting sleeve 30. In the preferred embodiment, four longitudinal slots 38 are evenly distributed around the circumference of the upper portion of the tubular setting sleeve 30. The purpose of these longitudinal slots 38 will become apparent below, and will be discussed in conjunction with the operation of the setting device of the present invention.

The lower portion of the tubular flaring sleeve 32 has an inner diameter sized to fit closely over the outer diameter of the top portion of the tubular setting sleeve 30. The tubular flaring sleeve 32 is also essentially cylindrical, and the bottom end 40 of the tubular flaring sleeve 32 is beveled with the bevel facing outwardly, as best shown in the sectional view of FIG. 1 and in FIG. 3. The thickness of the tubular flaring sleeve 32 is greater than the distance between the outer diameter of the tubular setting sleeve 30 and the inner diameter of the annular sealing flange 36, and it will be appreciated that when the beveled end 40 of the tubular flaring sleeve 32 is driven downwardly on the tubular setting sleeve 30, the beveled end 40 will flare the annular sealing flange 36 outwardly. Stated slightly differently, the outer diameter of the tubular flaring sleeve 32 above the beveled end 40 is greater than the inner diameter of the annular sealing flange 36, and when the beveled end 40 of the tubular flaring sleeve 32 is driven downwardly on the tubular setting sleeve 30, the beveled end 40 will flare the annular sealing flange 36 outwardly.

Located inside the tubular flaring sleeve 32 in the top portion thereof are a series of relatively coarse left-handed female screw-threads 42. It will be noted that the portion of the inner diameter of the tubular flaring sleeve 32 below the screw-threads 42 is sized to allow the tubular flaring sleeve 32 to slide downwardly on the tubular setting sleeve 30 until the beveled end 40 of the tubular flaring sleeve 32 reaches the bottom of the annular sealing flange 36 where the annular sealing flange 36 is attached to the tubular setting sleeve 30. The top edge 44 of the tubular flaring sleeve 32 may be beveled on the inside thereof to facilitate entry into the tubular flaring sleeve 32.

Figure 3:
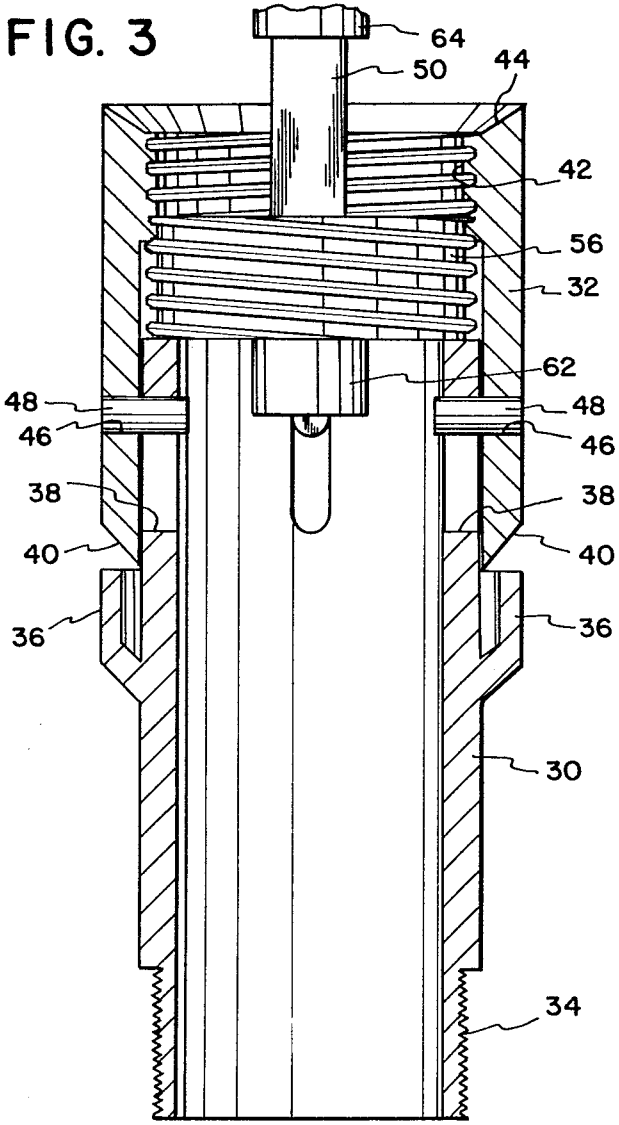
FIG. 3 is a cutaway view of the liner setting apparatus illustrated in FIGS. 1 and 2, showing the insertion configuration of the apparatus.

Completing the construction of the tubular flaring sleeve 32 are a plurality of apertures 46 therein, with four apertures in the preferred embodiment corresponding with the four longitudinal slots 38 in the tubular setting sleeve 30. The four apertures 46 are located in the tubular flaring sleeve 32 to be aligned with the top of the four longitudinal slots 38 in the tubular setting sleeve 30 when the beveled end 40 of the tubular flaring sleeve 32 is located immediately above the annular sealing flange 36 of the tubular setting sleeve 30 in a first position, as best shown in FIGS. 1 and 3. When the beveled end 40 of the tubular flaring sleeve 32 reaches the bottom of the annular sealing flange 36 where the annular sealing flange 36 is attached to the tubular setting sleeve 30, the four apertures 46 in the tubular flaring sleeve 32 will be aligned with the bottom of the four longitudinal slots 38 in the tubular setting sleeve 30 in a second position.

A plurality of pins 48 (four in the preferred embodiment) are inserted into the apertures 46 in the tubular flaring sleeve 32 and through the longitudinal slots 38 in the tubular setting sleeve 30. The pins 48 may have an interference fit in the apertures 46, or they may be welded to the tubular flaring sleeve 32 or fixedly attached in another manner. The ends of the pins 48 fit flush with the outer surface of the tubular flaring sleeve 32. It will be perceived that the pins 48 restrict the movement of the tubular flaring sleeve 32 on the tubular setting sleeve 30 between the afore-mentioned first and second positions.

The setting apparatus of the present invention includes an elongated arbor 50 having a square cross-section except at the upper end 52 and lower end 54 thereof. The upper end 52 and the lower end 54 of the elongated arbor 50 are turned down to circular cross-sections, and are screw-threaded on the outer diameters thereof. A setting nut 56 having on its outer diameter the left-handed male screw-threads 58 corresponding to the female screw-threads 42 on the inner diameter of the top portion of the tubular flaring sleeve 32 has a substantially square crosssection opening 60 therethrough to admit the elongated arbor 50.

The elongated arbor 50 is inserted through the square crosssection opening 60 in the setting nut 56, and a lower internally screw-threaded hanger coupling 62 is screwed onto the lower screw-threaded end 54 of the elongated arbor 50 to dependably hold the setting nut 56 on the elongated arbor 50. An upper internally screw-threaded hanger coupling 64 is screwed onto the upper screw-threaded end 52 of the elongated arbor 50, and it is to this upper internally screw-threaded hanger coupling 64 that the elongated tubing string 28 is attached.

To install the elongated tubular liner 18 in the tubular well casing 12, the setting nut 56 is screwed into the top of the tubular flaring sleeve 32 until the bottom of the setting nut 56 contacts the top edge of the tubular setting sleeve 30, as shown in FIG. 3. At this time, the pins 48 are at the top ends of the longitudinal slots 38 in the tubular setting sleeve 30, which is the first position mentioned above. In this first position, the beveled end 40 of the tubular flaring sleeve 32 is approximately even with the top of the annular sealing flange 36 of the tubular setting sleeve 30.

It may be noted that by screwing the setting nut 56 fully into the top of the tubular flaring sleeve 32 and into contact with the top edge of the tubular setting sleeve 30, the setting apparatus will remain in the first position. This prevents the annular sealing flange 36 from being prematurely flared outwardly when the setting apparatus is lowering the elongated tubular liner 18 into the tubular well casing 12. Even if the inner wall of the well casing 12 is roughened by cement deposits or scale, or if the segments of the casing are misaligned, kinked, out of round, or otherwise damaged, the design of the setting apparatus of the present invention will prevent the tubular flaring sleeve 32 from prematurely flaring the annular sealing flange 36 on the tubular setting sleeve 30.

Figure 4:
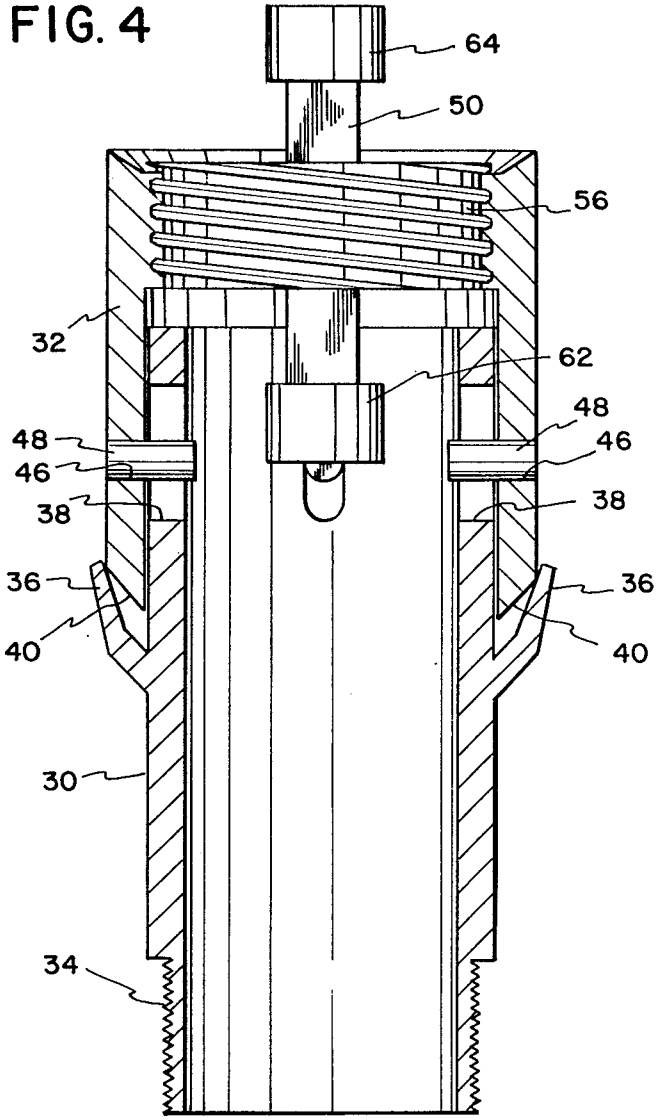
FIG. 4 is a cutaway view of the liner setting apparatus illustrated in FIGS. 1 through 3, showing the apparatus being set for expansion into a sealing relationship within the well casing.

The elongated tubular liner 18 is threaded onto the bottom of the tubular setting sleeve 30, and the top of the upper internally screw-threaded hanger coupling 64 is threaded onto the elongated tubing string 28, as shown in FIG. 1. The elongated tubular liner 18 and the setting apparatus are lowered in the tubular well casing 12 in a "running in" operation. When the elongated tubular liner 18 has been lowered to the bottom 16 of the well bore 14 in the tubular well casing 12, the setting nut 56 is backed partially out of the tubular flaring sleeve 32, to the position shown in FIG. 4. In this position, the bottom of the setting nut 56 is approximately even with the bottom of the screw-threads 42 in the tubular flaring sleeve 32. This frees the tubular flaring sleeve 32 to allow it to be driven toward the second position.

The tubing string 28 is reciprocated from the surface of the well for repeated impact of the upper internally screw-threaded hanger coupling 64 against the top of the setting nut 56. This repeated impact will cause the setting nut 56 to drive the tubular flaring sleeve 32 in a downwardly direction, urging the beveled end 40 of the tubular flaring sleeve 32 downwardly. The beveled end 40 of the tubular flaring sleeve 32 will flare the annular sealing flange 36 on the tubular setting sleeve 30 radially outwardly against the inner diameter of the tubular well casing 12. It will be immediately perceived that a dependable metal-to-metal seal is thereby achieved between the annular sealing flange 36 of the tubular setting sleeve 30 and the tubular well casing 12. This seal will effectively prevent the passage of sand or other particulate matter upwardly between the elongated tubular liner 18 and the tubular well casing 12 during operation of the well.

It will also be perceived that since the beveled end 40 of the tubular flaring sleeve 32 is centered around the outer diameter of the tubular setting sleeve 30, the beveled end 40 will not move off-center. It is apparent that it is impossible for the beveled end 40 not to seat perfectly. Accordingly, the seal which is achieved by driving the beveled end 40 of the tubular flaring sleeve 32 to flare the annular sealing flange 36 radially outwardly will be uniform and consistently satisfactory.

Following the flaring operation, the setting nut 56 may be removed by the elongated tubing string 28. The production tubing string (not shown) may be lowered into the tubular well casing 12. The excellent seal achieved between the annular sealing flange 36 of the tubular setting sleeve 30 and the interior of the tubular well casing 12 dependably prevents the production tubing from drawing sand and other particulates from the well.

It may therefore be appreciated from the above description of the construction and operation of the liner setting apparatus and method of the present invention that they effectively prevent the sealing flange 36 from being expanded prematurely when the liner 18 is being installed, even when the setting sleeve 30 may become momentarily stuck in the casing 12 while the liner 18 is being lowered into the well. The liner 18 may therefore be easily and conveniently installed, even in well casings which are more damaged than is typical.

In addition, the present invention also prevents the setting sleeve 30 from moving off center, which was previously caused by the flaring plate not seating properly, by maintaining alignment of the beveled end 40 of the flaring apparatus with respect to the setting sleeve 30. Accordingly, non-uniform seals, substandard seals, or even the lack of a seal are all prevented by the present invention. It may therefore be appreciated that the device and method of the present invention represents a substantial improvement in the ability to easily and properly install liners.

Accordingly, the present invention provides for an improved liner setting apparatus and method which will be easier to install, and which will not expand the seal prematurely. As such, it completely and positively inhibits the expansion of the seal until the liner is in place at the bottom of the casing. The present invention also ensures proper alignment of the liner setting apparatus, thereby preventing the apparatus from moving off-center, while forming a uniform seal. Finally, all of the aforesaid objectives and advantages are achieved without incurring any relative disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An apparatus for setting a production liner within a well casing upon the bottom of the well comprising:

an elongated tubular setting sleeve adapted to be mounted on the upper end of said liner,;

an annular sealing flange located around the outer diameter of said tubular setting sleeve at an intermediate portion thereof, the inner diameter of said annular sealing flange being spaced away from the outer diameter of said tubular setting sleeve except at the bottom of said annular sealing flange, where said annular sealing flange is attached to said tubular setting sleeve;

a tubular flaring sleeve having an inner diameter sized to fit closely over said outer diameter of the top portion of said tubular setting sleeve, the bottom end of said tubular flaring sleeve being beveled with the bevel facing outwardly, the beveled end of said tubular flaring sleeve flaring said annular sealing flange radially outwardly in a sealing relationship with said well casing when said beveled end of said tubular flaring sleeve is driven downwardly on said tubular setting sleeve;

tool means for lowering said liner, said tubular setting sleeve, and said tubular flaring sleeve into said well casing,; and means for preventing said tubular flaring sleeve from flaring said annular sealing flange outwardly prematurely.

2. An apparatus as defined in Claim 1, wherein said tubular setting sleeve and said tubular flaring sleeve are each essentially cylindrical.

3. An apparatus as defined in Claim 1, wherein the bottom of said annular sealing flange where it is attached to said tubular setting sleeve is angled to facilitate introduction of said tubular setting sleeve into said well casing.

4. An apparatus as defined in Claim 1, wherein said tubular setting sleeve is loosely receivable within said well casing, and the outer diameter of said annular sealing flange is designed to fit fairly closely within said well casing.

5. An apparatus as defined in Claim 1, wherein the thickness of said tubular flaring sleeve is greater than the distance between said outer diameter of said tubular setting sleeve and the inner diameter of said annular sealing flange.

6. An apparatus as defined in Claim 1, wherein said outer diameter of said tubular flaring sleeve above said beveled end is greater than the inner diameter of said annular sealing flange.

7. An apparatus as defined in Claim 1, wherein said tool means comprises:

a female threaded portion on the inner diameter of the top portion of said tubular flaring sleeve; and a setting nut having on its outer diameter male screwthreads corresponding to said female screwthreads on said inner diameter of the top portion of said tubular flaring sleeve, said setting nut being screwed into said female screw-threads on said inner diameter of the top portion of said tubular flaring sleeve to lower said well liner, said tubular setting sleeve, and said tubular flaring sleeve into said well casing.

8. An apparatus as defined in Claim 7, wherein said setting nut has a substantially square cross-sectional opening therethrough, additionally comprising:

an elongated arbor having a square cross-section except at the upper end and lower end thereof, said upper end and said lower end of said elongated arbor being turned down to circular cross-sections and screw-threaded on the outer diameters thereof, said elongated arbor being inserted through said square crosssection opening in said setting nut;

a lower internally screw-threaded hanger coupling screwed onto said lower screw-threaded end of said elongated arbor to dependably hold said setting nut on said elongated arbor;

an upper internally screw-threaded hanger coupling screwed onto said upper screw-threaded end of said elongated arbor, an elongated tubing string being attachable to said upper internally screwthreaded hanger coupling to lower said apparatus into said well.

9. An apparatus as defined in Claim 7, wherein said preventing means comprises:

said setting nut screwed into said top of said tubular flaring sleeve until the bottom of said setting nut contacts the top edge of said tubular setting sleeve, with said beveled end of said tubular flaring sleeve being located immediately above said annular sealing flange of said tubular setting sleeve, thereby preventing said annular sealing flange from being prematurely flared outwardly when the setting apparatus is lowering said liner into said well casing.

10. An apparatus as defined in Claim 7, wherein said screwthreads in said tubular flaring sleeve and on said setting nut are left-handed threads.

11. An apparatus as defined in Claim 1, additionally comprising:

means for restricting the relative movement between said tubular flaring sleeve and said tubular setting sleeve.

12. An apparatus as defined in Claim 11, wherein said restricting means comprises:

a plurality of longitudinal slots located in said tubular setting sleeve near the upper end thereof, said longitudinal slots being evenly distributed around the circumference of said tubular setting sleeve;

a plurality of apertures in said tubular flaring sleeve, said apertures corresponding with said longitudinal slots in said tubular setting sleeve; and a plurality of pins inserted into said apertures in said tubular flaring sleeve and through said longitudinal slots in said tubular setting, said pins restricting the movement of said tubular flaring sleeve on said tubular setting sleeve between the a first position wherein said beveled end of said tubular flaring sleeve is located immediately above the top of said annular sealing flange of said tubular setting sleeve, and a second position wherein said beveled end of said tubular flaring sleeve reaches said bottom of said annular sealing flange where said annular sealing flange is attached to said tubular setting sleeve.

13. An apparatus as defined in Claim 12, wherein the ends of said pins fit flush with the outer surface of said tubular flaring sleeve.

14. An apparatus as defined in Claim 12, wherein said pins are securely mounted in said apertures in said tubular flaring sleeve.

15. An apparatus for setting a production liner within a well casing upon the bottom of the well comprising:

an elongated tubular setting sleeve adapted to be mounted on the upper end of said liner, said tubular setting sleeve being loosely receivable within said well casing;

an annular sealing flange located around the outer diameter of said tubular setting sleeve at an intermediate portion thereof, the inner diameter of said annular sealing flange being spaced away from the outer diameter of said tubular setting sleeve except at the bottom of said annular sealing flange, where said annular sealing flange is attached to said tubular setting sleeve, the outer diameter of said annular sealing flange being designed to fit fairly closely within said well casing;

a tubular flaring sleeve having an inner diameter sized to fit closely over said outer diameter of the top portion of said tubular setting sleeve, the bottom end of said tubular flaring sleeve being beveled with the bevel facing outwardly, the beveled end of said tubular flaring sleeve flaring said annular sealing flange radially outwardly in a sealing relationship with said well casing when said beveled end of said tubular flaring sleeve is driven downwardly on said tubular setting sleeve;

tool means for lowering said liner, said tubular setting sleeve, and said tubular flaring sleeve into said well casing; and means for preventing said tubular flaring sleeve from flaring said annular sealing flange outwardly prematurely while said liner, said tubular setting sleeve, and said tubular flaring sleeve are being lowered into said well casing.

16. An apparatus for setting a production liner within a well casing upon the bottom of the well comprising:

an elongated tubular setting sleeve adapted to be mounted on the upper end of said liner;

an annular sealing flange located around the outer diameter of said tubular setting sleeve, the inner diameter of said annular sealing flange being spaced away from the outer diameter of said tubular setting sleeve except at the bottom of said annular sealing flange, where said annular sealing flange is attached to said tubular setting sleeve,;

a tubular flaring sleeve fitting closely over said outer diameter of the top portion of said tubular setting sleeve, the bottom end of said tubular flaring sleeve being beveled with the bevel facing outwardly, the beveled end of said tubular flaring sleeve flaring said annular sealing flange radially outwardly in a sealing relationship with said well casing when said beveled end of said tubular flaring sleeve is driven downwardly on said tubular setting sleeve; and tool means for lowering said liner, said tubular setting sleeve, and said tubular flaring sleeve into said well casing.

17. A method of setting a production liner within a well casing upon the bottom of the well comprising:

mounting an elongated tubular setting sleeve on the upper end of said liner, said tubular setting sleeve having an annular sealing flange located around the outer diameter of said tubular setting sleeve at an intermediate portion thereof, the inner diameter of said annular sealing flange being spaced away from the outer diameter of said tubular setting sleeve except at the bottom of said annular sealing flange, where said annular sealing flange is attached to said tubular setting sleeve;

installing a tubular flaring sleeve having an inner diameter sized to fit closely over said outer diameter of the top portion of said tubular setting sleeve onto said top portion of said tubular setting sleeve, the bottom end of said tubular flaring sleeve being beveled with the bevel facing outwardly;

lowering said liner, said tubular setting sleeve, and said tubular flaring sleeve into said well casing; and flaring said annular sealing flange radially outwardly in a sealing relationship with said well casing by driving said beveled end of said tubular flaring sleeve downwardly on said tubular setting sleeve after said liner, said tubular setting sleeve, and said tubular flaring sleeve have been lowered to the bottom of said well.

18. A method as defined in Claim 17, additionally comprising:

preventing said tubular flaring sleeve from flaring said annular sealing flange outwardly prematurely prior to said liner, said tubular setting sleeve, and said tubular flaring sleeve being lowered to the bottom of said well.

* * * * *